US005287788A

United States Patent [19]

Hill, Jr.

[11] Patent Number: 5,287,788

[45] Date of Patent: Feb. 22, 1994

[54] TONAL EXPONENT

[76] Inventor: Richard W. Hill, Jr., 239 Dillard Dr., Goose Creek, S.C. 29445

[21] Appl. No.: 828,036

[22] Filed: Jan. 30, 1992

[51] Int. Cl.[5] ..... G10D 3/00

[52] U.S. Cl. ..... 84/315

[58] Field of Search ..... 84/315, 316, 317, 318, 84/319

[56] References Cited

U.S. PATENT DOCUMENTS

| | | | |
|---|---|---|---|
| 3,915,051 | 10/1975 | Kincaid | 84/317 |
| 4,204,454 | 5/1980 | Severn | 84/315 |
| 4,545,282 | 10/1985 | Arnett et al. | 84/317 |
| 4,566,365 | 1/1986 | Huston, Jr. | 84/317 |
| 4,583,440 | 4/1986 | Powell, Jr. | 84/318 |
| 4,622,880 | 11/1986 | Glemming et al. | 84/317 |
| 4,926,732 | 5/1990 | Collins et al. | 84/318 |
| 5,101,706 | 4/1992 | Kilgore | 84/318 |

*Primary Examiner*—Michael L. Gellner
*Assistant Examiner*—Cassandra Spyrou

[57] ABSTRACT

The 'Tonal Exponent' is a mechanical device which clamps onto the neck of a stringed musical instrument and allows one or more of the instrument's strings to be selected and mechanically depressed and held-down throughout a song or a portion of a song. The notes and chords thus produced span a far greater lateral distance than the human hand is capable of stretching, and open up a whole new spectrum of possible chord and string sounds. A unique new recurring rhythmic element, 'constancy within change,' is also introduced by use of the device, giving an invariable yet subtle syncopation to those strings engaged while allowing the musician to manipulate the other strings as he or she desires. A wide new range of atonal, microtonal, and polytonal musical explorations are made possible by use of the device.

1 Claim, 3 Drawing Sheets

TONAL EXPONENT

BRIEF SUMMARY

The 'Tonal Exponent' is a device which clamps onto the neck of a stringed musical instrument (such as a guitar, or mandolin, etc.,) and permits the musician, through the use of a plurality of individually selectable string pegs, to mechanically depress and lock-down one or more of the instrument's strings to a note value or octave different than that being played by the musician's fingers. The device itself may be easily moved to different positions or frets along the fingerboard, further extending the range of usable notes and chord configurations. The device is positioned on the instrument's neck, usually between the body of the instrument and the musician's fingering hand, and it depresses only those strings which have been selected, while leaving all other strings unobstructed and responsive to normal note and chord fingering. The notes and chords thus produced span a far greater lateral distance than the human hand is physically capable of stretching, and open up not only a whole new spectrum of chords and string sounds but introduce a unique new recurring rhythmic element to the music as well: the element of 'constancy within change.' The note or notes selected by the 'Tonal Exponent' are repeated invariably with each strum of the instrument, and this almost subliminal static repetition interacts with the note and chordal changes being performed by the musician to produce both atonal and microtonal sounds that are novel and pleasing to the ear, and which open up a whole new area of inquiry into musical harmony and polytonality.

BRIEF DESCRIPTION OF VIEWS

Figure 1:
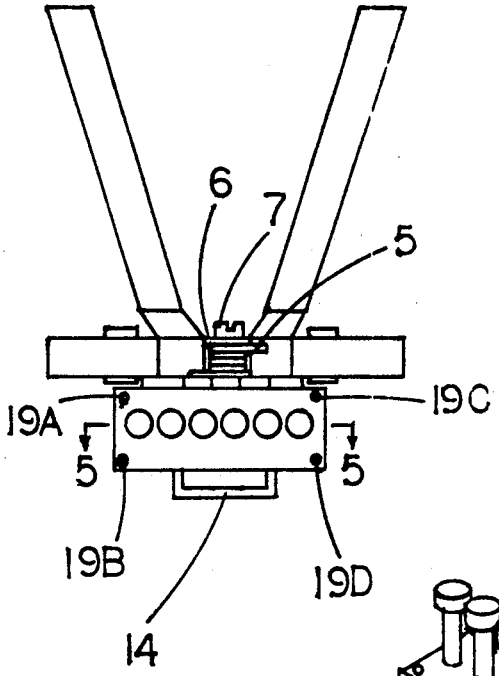
FIG. 1 is a top view of the present invention.
Figure 2:
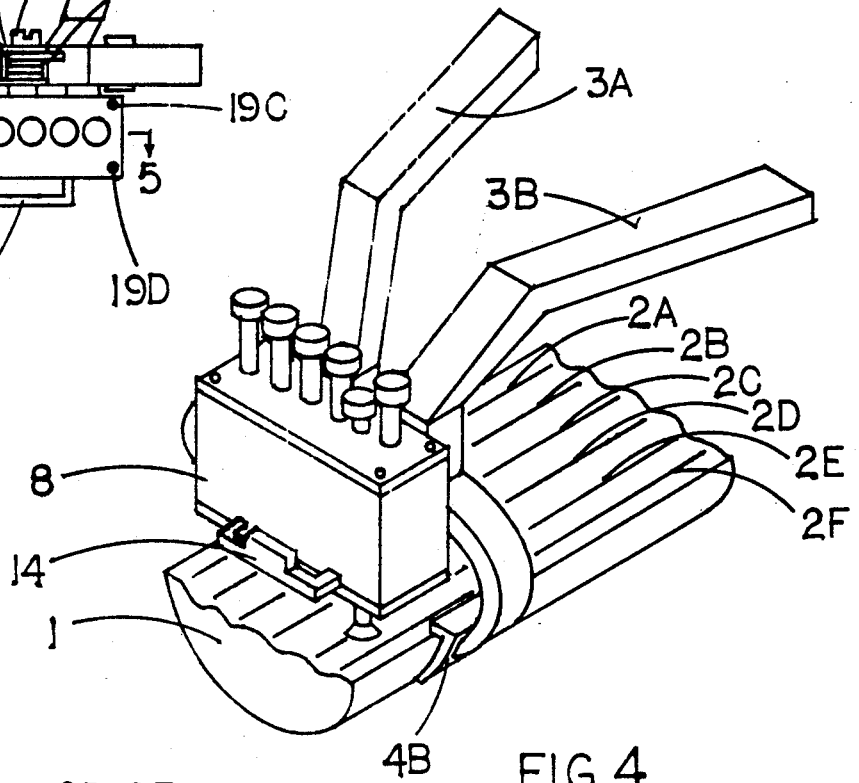
FIG. 2 is an isometric view of the device attached to the neck of a musical instrument.
Figure 3:
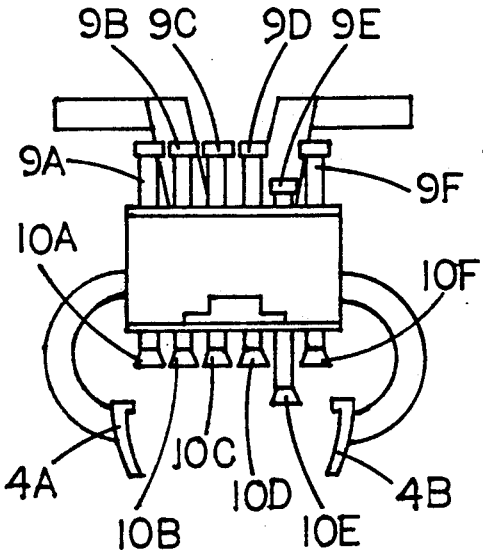
FIG. 3 is a front view of the device.
Figure 4:
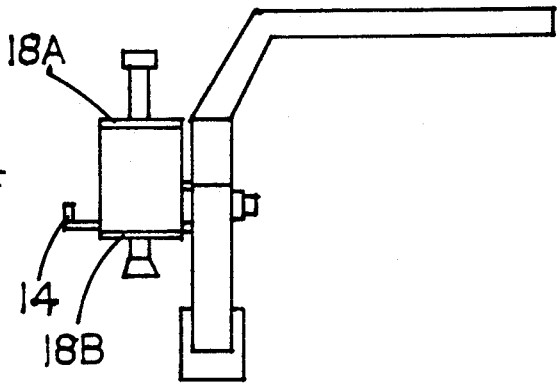
FIG. 4 is a right side view of the device.
Figure 5:
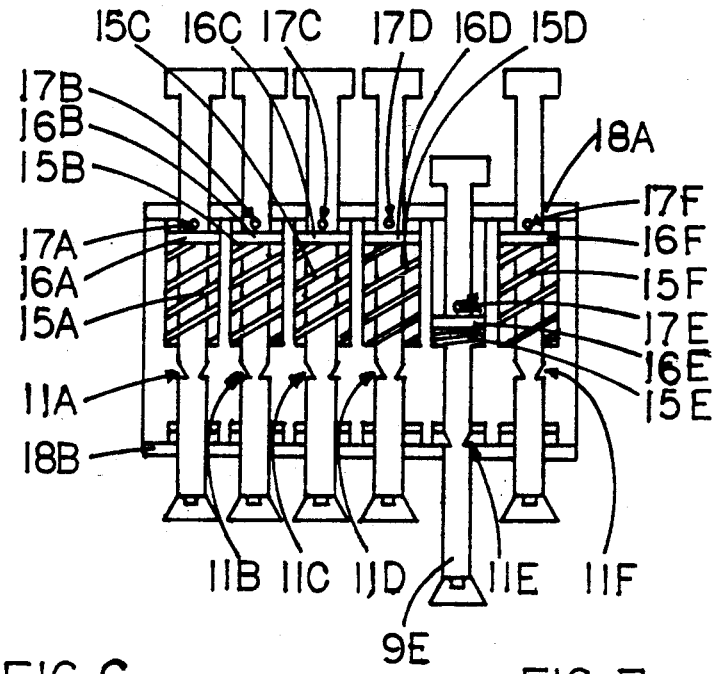
FIG. 5 is a front cross-sectional view of the ballast taken along line 5—5 of FIG. 1, and showing the internal parts of the ballast, i.e. the string pegs, rubber peg shoes, peg springs, peg washers, and peg pins, all in their at-rest positions except for the fifth string peg (9E), which is depicted in the engaged position.
Figure 6:
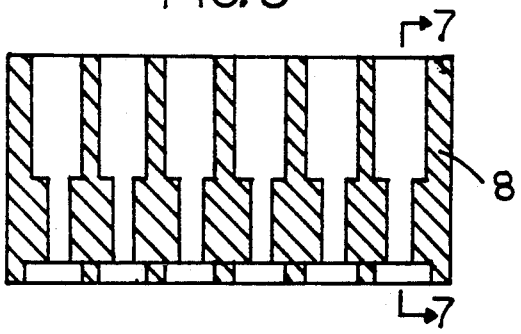
FIG. 6 is a right side cross-sectional view taken along line 6—6 of FIG. 7.
Figure 7:
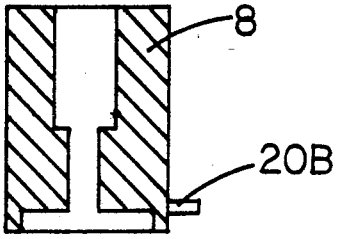
FIG. 7 is a front cross-sectional view of the ballast, similar to FIG. 5 but with all parts removed to show the drilling and milling of the ballast.
Figure 8:
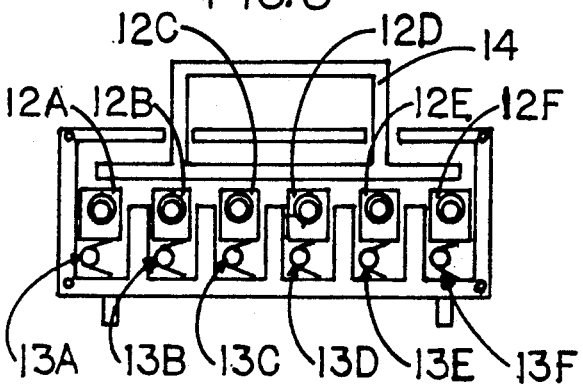
FIG. 8 is a side view of a string peg, with a peg pin inserted, and a top and side view of a rubber peg shoe.
Figure 9:
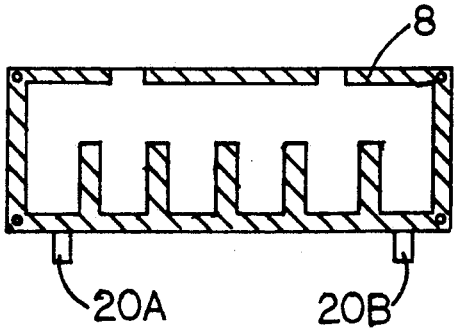
FIG. 9 is a bottom view of the ballast; the white area is milled 3/32" recessed in relation to the hatched area to accommodate the retainer plates, locking springs, and release bar.
Figure 10:
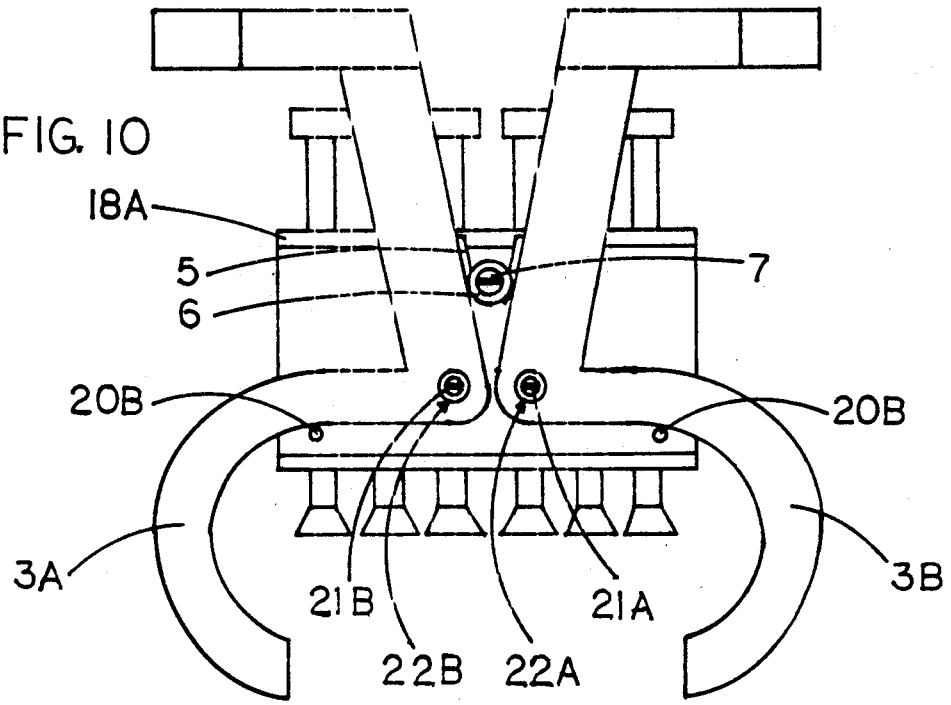
FIG. 10 is a bottom view of the ballast, with parts inserted.
Figure 11:
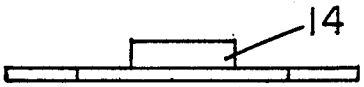
FIG. 11 is a top and side view of a retainer plate.
Figure 12:
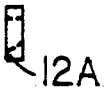
FIG. 12 is a rear view of the invention.
Figure 13:
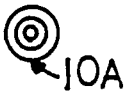
FIG. 13 is a front and side view of a rubber clamp boot.
Figure 14:
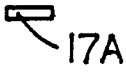
FIG. 14 is a top view of the ballast, with all parts removed to illustrate drilled holes.
Figure 15:
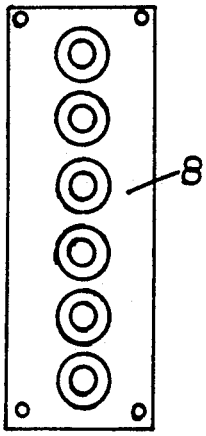
FIG. 15 is a top and front view of the release bar.
Figure 16:
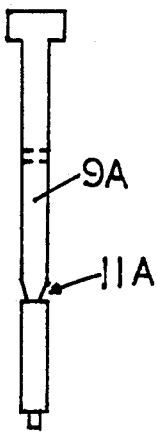
FIG. 16 is a top view of the top cover plate; the bottom cover plate is identical to the top cover plate (except for the numerical designators for the screw holes, which are listed in FIG. 1.)
Figure 17:
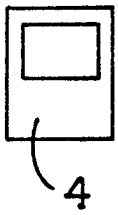
Figure 18:
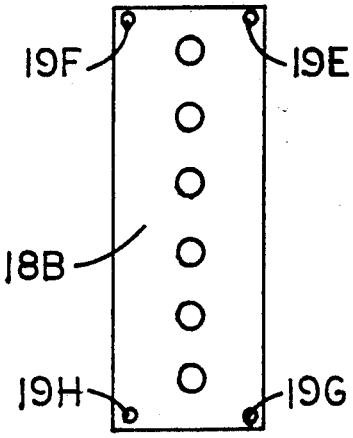

The device is manufactured from medium grade aluminum or other suitable metal, with hard rubber clamp boots and peg shoes attached by use of commercial cement.

DETAILED DESCRIPTION

The 'Tonal Exponent' is clamped onto the neck of a musical instrument 1 by means of squeezing the handles of the clamp 3A, 3B together, which causes the clamps and rubber clamp boots 4A, 4B to extend outward. The device is then positioned over the neck of the instrument and the handles of the clamp 3A, 3B are released, permitting the mainspring 5 to apply and maintain sufficient pressure on the clamps to keep the device seated firmly on the neck of the instrument. The mainspring washer 6 and mainspring screw 7 attach the mainspring to the ballast 8 and keep the mainspring positioned properly between the clamps. The clamps are mounted to the ballast by means of clamp screws 21A, 21B and clamp washers 22A, 22B. Clamp limit posts 20A, 20B, mounted on the ballast 8, insure that the clamps remain vertically aligned with the ballast when the 'Tonal Exponent' is not fitted to an instrument neck. Rubber boots 4A, 4B on each leg of the clamp assure a snug fit without scratching the instrument.

The ballast 8 houses the string pegs 9, retainer plates 12, and release bar 14, and serves to position the string pegs precisely over the instrument's strings 2A–2F. When a string peg 9A–9F is selected and depressed it continues downward until the rubber peg shoe 1OA–10F on the foot of the peg presses the instrument's string down against the fingerboard of the instrument's neck. A latching notch 11A–11F on the string peg is so positioned at that time that the retainer plate 12A–12F for the selected peg is forced forward by the locking spring 13A–13F. The retainer plate 12, which has a hole drilled in it of a diameter slightly larger than that of the string peg shaft 9, and through which the string peg shaft passes, is forced forward by the locking spring 13 and slides into the latching notch 11 on the string peg. The string peg is now latched firmly down into position. When the musician's finger is removed from the string peg 9, the peg remains depressed, holding the selected instrument string tightly against the fingerboard. One or more of the instrument strings may be selected and engaged simultaneously by the plurality of string pegs, and more than one 'Tonal Exponent' may be placed on an instrument's neck at the same time.

To release string pegs that have been engaged the release bar 14 must be pressed. The release bar abuts, but is not connected to, the independently moving retainer plates 12. When the release bar 14 is pressed it pushes all of the retainer plates 12 back at the same time; the large-diameter holes in the retainer plates, which until now have been moved off-center and forced forward against the string peg shafts by the action of the locking springs 13, are now centered directly over the string peg shafts, thereby disengaging the retainer plates 12 from the latching notches 11 on the pegs. The string pegs 9 are now free to travel upward. The peg springs 15A–15F, which were compressed when the string pegs 9 were pushed to the 'down' position, now expand, pushing up on lithe peg washers 16A–16F and the peg pins 17A–17F, thereby returning the string pegs to their upright position. The top cover plate 18A is impacted by, and limits, the upward movement of the peg pins 17 and therefore of the string pegs themselves. The bottom cover plate 18B holds the retainer plates 12, locking springs 13, and release bar 14 in position. The top and bottom cover plates are secured to the ballast 8 by screws 19A–19H. With all of the string pegs in the 'up' position, the instrument's strings are unaffected and will operate normally.

I, the inventor, claim:

1. A tonal clamp for a musical stringed instrument having a neck and a plurality of strings comprising;

a ballast housing, a plurality of string pegs, a retainer, and a release mechanism;

a clamp means for supporting and clamping said ballast to the neck; said clamp means including a pair of handles and a pair of arms; said arms having means for grasping the neck on opposite side surfaces and for supporting the ballast with the string pegs in alignment over the strings.

* * * * *